United States Patent [19]

Chakrabarti

[11] 4,178,204

[45] * Dec. 11, 1979

[54] WET-STRENGTH OF WET GLASS FIBER MATS BY TREATMENT WITH ANIONIC POLYELECTROLYTES

[75] Inventor: Paritosh M. Chakrabarti, Wayne, N.J.

[73] Assignee: GAF Corporation, New York, N.Y.

[ * ] Notice: The portion of the term of this patent subsequent to Dec. 11, 1996, has been disclaimed.

[21] Appl. No.: 872,000

[22] Filed: Jan. 24, 1978

[51] Int. Cl.[2] ..... D21H 5/18

[52] U.S. Cl. ..... 162/156; 162/158; 162/168 R; 162/182; 162/184; 162/186

[58] Field of Search ..... 162/152, 158, 156, 168 R, 162/168 N, 168 NA, 183, 182, 184, 186; 428/375, 378

[56] References Cited

U.S. PATENT DOCUMENTS

| | | | |
|---|---|---|---|
| 2,721,139 | 10/1955 | Arledter | 162/145 |
| 3,014,835 | 12/1961 | Feigley | 162/156 |
| 3,300,372 | 1/1967 | Bauer | 162/145 |
| 3,573,158 | 3/1971 | Pall | 162/156 |
| 3,749,638 | 7/1973 | Renaud et al. | 162/156 |
| 4,007,083 | 2/1977 | Ring et al. | 162/184 |

FOREIGN PATENT DOCUMENTS

| | | | |
|---|---|---|---|
| 838373 | 2/1975 | Belgium . | |
| 685665 | 5/1964 | Canada | 162/157 R |
| 787649 | 6/1968 | Canada | 162/157 R |

*Primary Examiner*—S. Leon Bashore
*Assistant Examiner*—Peter Chin
*Attorney, Agent, or Firm*—Walter C. Kehm; Walter Katz

[57] ABSTRACT

In accordance with the present invention, there is provided herein a method of increasing the strength of wet glass fiber mats prepared by the wet-laid process. The wet-strength of such freshly prepared glass fiber mats are improved in this invention by treating the wet mat with a dilute solution of an anionic polyelectrolyte. As a feature of the invention, the wet-strength of such mats are increased substantially so that they may be conveniently handled and transferred, even manually, for further processing, e.g. for applying binders and drying, into the finished glass fiber mat product.

20 Claims, No Drawings

WET-STRENGTH OF WET GLASS FIBER MATS BY TREATMENT WITH ANIONIC POLYELECTROLYTES

BACKGROUND OF THE INVENTION

1. Field of the Invention

This invention relates to the manufacture of uniform, high quality, glass fiber mat products made by the wet-laid process, and, more particularly, it is concerned with a method of improving the wet-strength of freshly prepared, wet glass fiber mats, so that they can be conveniently handled and transferred, even mutually, in the production line.

2. Description of the Prior Art

High strength, uniform thin sheets or mats of glass fibers are finding increasing application in the building materials industry, as for example, in asphalt roofing shingles and as backing sheets for vinyl flooring. These glass fiber mats are replacing similar sheets made traditionally of asbestos fibers. Glass fiber mats usually are made commercially by a wet-laid process, which is carried out on modified paper or asbestos making machinery, as described, for example, in the book by O. A. Battista, *Synthetic Fibers in Papermaking* (Wiley) N.Y. 1964. A number of U.S. patents also provide a rather complete description of the wet-laid process, including U.S. Pat. Nos. 2,906,660; 3,012,929; 3,050,427; 3,103,461; 3,228,825; 3,760,458; 3,766,003; 3,838,995 and 3,905,067. The German OLS No. 2454354 (Fr. Demande No. 2,250,719), June, 1975, also is pertinent art in this field.

In general, the known wet-laid process for making glass fiber mats comprises first forming an aqueous suspension of short-length glass fibers under agitation in a mixing tank, then feeding the suspension through a moving screen on which the fibers enmesh themselves into a freshly prepared wet glass fiber mat, while the water is separated therefrom. However, unlike natural fibers, such as cellulose or asbestos, glass fibers do not disperse well in water. Actually, when glass fibers, which come as strands or bundles of parallel fibers, are put into water and stirred, they do not form a well-dispersed system. In fact, upon extended agitation, the fibers agglomerate as large clumps which are very difficult to redisperse.

In an attempt to overcome this inherent problem with glass fibers, it has been the practice in the industry to provide suspending aids for the glass fibers, including surfactants, in order to keep the fibers separated from one another in a relatively dispersed state. Such suspending aids usually are materials which increase the viscosity of the medium so that the fibers can suspend themselves in the medium. Some suspending aids actually are surfactants which function by reducing the surface attraction between the fibers. Unfortunately, however, none of the available suspending aids are entirely satisfactory for large volume manufacture of useful, uniform glass fiber mats.

In our copending patent application, Ser. No. 851,863, filed Nov. 15, 1977, there is described an improved method of preparing chopped glass fiber dispersions in water by admixing the fibers with a small amount of an amine oxide. While the present invention is not limited to this method of forming the initial glass fiber dispersions, it is to be considered a preferred embodiment thereof, and the examples which follow will reflect the advantageous use of amine oxide surfactants to form the initial glass fiber dispersions. However, any other dispersant may be used, including the select quaternary ammonium cationic surfactants described in our copending application, Ser. No. 876,651, filed Feb. 10, 1978 which compounds have the following formula:

$$R_1-\overset{\overset{\displaystyle R_2}{|}}{\underset{\underset{\displaystyle R_3}{|}}{N^{\oplus}}}-R_4 \quad X^{\ominus}$$

where $R_1$, $R_2$, $R_3$ and $R_4$ are selected from the group consisting of aliphatic and aromatic hydrocarbon radicals, straight chain or branched, or two or more form a cyclic group, saturated or unsaturated, substituted or unsubstituted, at least two of said radicals containing at least 10 carbon atoms each, being the same or different, the sum of the carbon atoms in $R_1$, $R_2$, $R_3$ and $R_4$ being at least 22 and less than about 48, and X is an anion.

Of course, since the dispersing aid acts to suspend the individual glass fibers away from each other, the wet-strength of the wet mat formed on the screen may be lessened to some degree by the use of good dispersion aids, such as amine oxides.

The poorer wet-strength of such mats, however, does not mean poor strength of the dry mats and/or of the final dry and resin-bonded mat product, but it can create some problems during further processing of the wet mat. In commercial production of glass mats, for example, the wet mat formed on the foraminous belt is transferred to other units, such as the drying and the bonding resin application units of the production line. In each of these units, the wet mat is supported on felts or drums; however, it does remain unsupported at the transfer points from one unit to another. Furthermore, at the front end of the line, the wet mat from the foraminous belt often is manually transferred from one unit to another. If the wet mat as formed is too weak, it cannot be easily transferred manually from one unit to another. Furthermore, poor wet strength leads to occasional breakage of the mat in unsupported transfer areas during production, leading to undesirable interruptions and material waste.

The materials applied to the wet-mat in this invention to improve its wet-strength is to be distinguished from the conventional resin binders which are applied to the dry mat product. The former materials are used herein only to improve the wet strength of the wet mat sufficient to enable it to be transported, even manually, through the production line.

In general, for a wet-laid glass fiber process to be effective, it is necessary that it meet several rigid criteria simultaneously which can provide means for making the desired high quality, uniform finished glass fiber mat product at a rapid rate of production in an economically acceptable process. For example, the process preferably should provide a uniform dispersion of glass fibers in water effectively at low surfactant concentrations, at high glass fiber consistencies, preferably not be accompanied by a substantial increase in the viscosity of the medium, and should be capable of producing wet glass fiber mats at the screen which have a uniform distribution of fibers characterized by a multidirectional array of fibers.

The process also should provide means for improving the wet-strength properties of such freshly prepared wet glass fiber mats, so that it can be conveniently transferred, even manually, to other units in the production line, such as the drying and binding units, without tearing or breaking the wet mat during handling. The means for improvement in wet-strength of such wet mats should be effective for such mats formed from any suspending aid or dispensing surfactant, even with those which provide excellent glass fiber dispersions. The materials used for treating the wet mats to improve its strength preferably should be readily available, at low cost, and be capable of use either by direct spraying in dilute solution onto the wet mats at any convenient point in the production line.

These and other objects and features of the invention will be made apparent from the following more particular description of the invention.

SUMMARY OF THE INVENTION

In accordance with the present invention, there is provided herein an improved method for making glass fiber mats by the wet-laid process. The current invention is concerned particularly with a method of improving the wet-strength of wet mats made from surfactant-aided glass fiber dispersions, such as described in the aforementioned copending application. The process of improving the wet-strength of these mats, according to this invention, comprises treating the wet mat with a dilute solution of an anionic polyelectrolyte surfactant. A convenient method of carrying out this post-treatment consists of spraying the solutions directly onto the wet mats, whereupon its wet strength is improved dramatically and immediately. The solution may be applied to the wet mat at any convenient point in the production-flow; however, usually it is advisable to apply it upon formation of the wet mat at the screen. Subsequent processing of the treated mat then can be carried out without possibility of tearing or breaking of the mat.

DETAILED DESCRIPTION OF THE INVENTION

Anionic polyelectrolytes suitable for use herein are those which are either soluble in water or can provide a soluble or dispersable salt in water, such as with an alkali metal hydroxide, ammonia or a low molecular weight organic amine. The anionic polyelectrolyte has the structural formula:

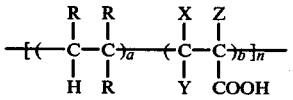

wherein each R can be the same or different and is selected from the group consisting of hydrogen, lower alkoxy, hydroxy, lower alkylcarbonyloxy, hydroxy lower alkyl, lower alkyl, phenyl, carboxy, lower alkoxycarbonyl, lower alkylcarbonyloxy lower alkyl, amido and carbamyl, with the proviso that only one R can be lower alkyl or phenyl; wherein X, Y and Z can be the same or different and are each selected from the group consisting of hydrogen, lower alkyl, carboxy, lower alkoxycarbonyl, with the proviso that at least one of X, Y and Z be selected from the group consisting of carboxy and lower alkoxycarbonyl, and, when X and Y are each lower alkoxycarbonyl, Z is carboxy or lower alkoxycarbonyl, with the further proviso that only one of X, Y and Z can be lower alkyl; a can be 0 to less than 1 and a+b=1; n is a whole integer which ranges from about 5 to about 10,000.

The equivalent weight of the polyelectrolyte preferably is less than 200, calculated as the acid form. The term "equivalent weight" as used herein is intended to denote the equivalent weight of the substance in grams, which is calculated by dividing its formula weight by its valency. In the present case of the acids, the valency is the number of replaceable hydrogen atoms.

Typical of the polyelectrolytes encompassed by the above structural formula are the homopolymers of acrylic acid, methacrylic acid, maleic acid, fumaric acid, itaconic acid and their copolymers with one or more copolymerizable monomers such as acrylamide, an acrylonitrile hydrolyzate, lower alkyl esters of unsaturated aliphatic acids as described above, lower alkyl vinyl ethers, ethylene, styrene, and the like. Preferably, the polyelectrolyte is a polyacrylic acid, polymethacrylic acid or copolymers of acrylic and methacrylic acids, and maleic acid with methyl vinyl ethers.

Although polyelectrolytes of a wide range of molecular weight having a degree of polymerization (n) from 5 to 10,000 can be employed in the present invention, the preferred polyelectrolytes exhibit a degree of polymerization (n) ranging from about 50 to about 3,000.

Specific anionic polyelectrolytes useful in the invention thus include polyacrylic acid, polymethacrylic acid, polymaleic acid, polyitaconic acid, copolymaleic acid/acrylic acid, copolymaleic acid/methylvinyl ether, half methyl and ethyl esters of copolymaleic acid/methyl vinyl ether. Others are described in U.S. Pat. No. 3,377,249 and are included herein by reference.

In a typical wet-laid process for making glass fiber mats, a stock suspension of the fibrous material of predetermined fiber consistency is prepared in a mixing tank. The suspension then is pumped into a head box of a papermaking machine where it may be further diluted with water to a lower consistency. The diluted suspension then is distributed over a moving foraminous belt under suction to form a non-woven fiber structure or wet mat on the belt. This wet mat structure then is treated as described herein to improve its wet-strength. The thus-treated wet-mat may be dried, if necessary, then furnished with a resin binder, and, finally, thoroughly dried to give a finished non-woven glass fiber mat product.

The initial glass fiber filaments or strands generally are chopped into bundles of fibers about ¼" to 3" in length, usually about ½" to 2", and preferably about 1" long, and usually about 3 to 20 microns in diameter, and, preferably about 15 microns. In a preferred embodiment of the invention, the glass fibers are added to water containing an amine oxide surfactant, which forms a well-dispersed fiber composition. Suitably, the amine oxide is present at a concentration of about 5–500 ppm of the solution and preferably about 10–25 ppm. Alternatively, the chopped glass fibers may be coated initially by spraying or otherwise applying the amine oxide surfactant thereon, and then dispersing the coated fibers in the aqueous medium. Suitably, the coated fibers contain about 0.01 to 1% by weight of the amine oxide, and, preferably, between 0.025 to 0.25%. Other suspending aids or surfactants known in the art also may be used, however.

The glass fibers may be dispersed in the amine oxide surfactant at relatively high fiber consistencies while still retaining the effective dispersion characteristics of the composition. For example, a fiber consistency of from about 0.001% to about 3.0% may be used, and, preferably, about 0.05% to about 1% is employed, based upon the weight of the fibers in the water. Such compositions furnish excellent dispersions when agitated in conventional mixing equipment. As mentioned, if desired, the highly concentrated fiber dispersion compositions may be diluted at the head box, usually to a consistency of about 0.1% to about 0.3%, and, preferably about 0.2%, which, however, is still a highly concentrated fiber dispersion by conventional standards.

The dispersion compositions are formed without any substantial change in the viscosity of the medium or of generation of unwanted foams during the process. Furthermore, the dispersions preferably are prepared at or near a neutral pH condition, or perhaps under slightly alkaline conditions, again, without affecting the good quality of the dispersions, or of the finished glass mat products produced therefrom.

These dispersion compositions produce wet glass fiber mats which have a high density of fibers therein and which are uniformly distributed throughout the mat in a multidirectional array. The finished mats show excellent tensile strength properties, too. The rate of production of the mats is very rapid, indeed, in this invention. In fact, a rate of mat production of over 500 linear ft./min. using conventional paper-making equipment is readily achievable in this process.

The amine oxide surfactants for forming the initial glass fiber dispersing are tertiary amine oxides having the formula:

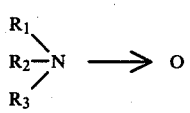

where $R_1$, $R_2$ and $R_3$ suitably are hydrocarbon groups containing between 1–30 carbon atoms. The hydrocarbon groups can be aliphatic or aromatic, and, if aliphatic, can be linear, branched or cyclic in nature, and can be the same or different in each radical. The aliphatic hydrocarbon radical can contain ethylenic unsaturation. Preferably the aliphatic groups are selected from among alkyl groups, such as lower alkyl or hydroxyalkyl groups having from 1–4 carbon atoms, and substituted alkyl groups thereof, or long chain alkyl groups, having from 12–30 carbon atoms, such as stearyl, laurel, oleyl, tridecyl, tetradecyl, hexadecyl, dodecyl, octadecyl, nonadecyl, or substituted groups thereof, derived from natural or synthetic sources. The sum of the $R_1$, $R_2$ and $R_3$ groups is about 14–40 carbon atoms, and most preferably, about 18–24 carbon atoms.

Typical amine oxides include Aromox DMHT from Armak, a dimethyl hydrogenated tallow amine oxide, Ammonyx SO from Onyx, a dimethylstearylamine oxide, Aromox DM16 from Armak, a dimethylhexadecylamine oxide, and Aromox T/12 from Armak, a bis(2-hydroxyethyl) tallow amine oxide, where $R_T$=3% tetradecyl, 27% hexadecyl, 16% octadecyl, 48% octadecenyl and 6% octadecadienyl. $R_{HT}$=hydrogenated $R_T$ (saturated), although others known in the art may be used as well.

The examples which follow will further illustrate the invention, but are not to be considered as being limiting of the principles or practice of the invention.

EXAMPLE 1

Formation Of Wet Glass Fiber Mats By Wet-Laid Process (Laboratory Control Experiment)

To 7 liters of a 50 ppm solution of dimethylhydrogenated tallowamine oxide (Aromox DMHT from Armak) was added 7g of chopped E-glass (1½" long, 15 microns diameter), with stirring, to form a good fiber dispersion. The dispersion then was carried through a laboratory Williams paper-making apparatus to form a 10"×11" (=110 sq. inches) wet mat. The glass fibers in this wet mat were very evenly distributed throughout; however, it was too weak to be lifted by holding at the two corners. It could be transferred from the frame of the apparatus to another flat support (for drying) only by putting the flat surface on the frame and carefully turning the frame upside down.

EXAMPLES 2–9

(Invention Experiments)

EXAMPLE 2

The procedure of Example 1 was repeated except that the wet mat was sprayed lightly with a 0.5% aqueous solution of Gantrez® S-95 (copolymaleic acid methylvinyl ether) from GAF. The wet mat now showed excellent wet-strength properties, it could be easily lifted up from the frame byholding its two corners and transferred directly to another support for drying. The dried, finished mat had good mat qualities.

EXAMPLE 3

The procedure of Example 2 was repeated using a 0.5% aqueous solution of the partial sodium salt (pH=7) of Gantrez® ES-225 (half methyl ester of copolymaleic acid methyl vinyl ether) from GAF. The wet strength of the mat after spraying with this material was similar in strength to that of Example 2.

EXAMPLE 4

The procedure of Example 2 was repeated using a 0.5% solution of polyacrylic acid (MW 30,000) with similar results in improved wet-strength properties of the wet mat.

EXAMPLE 5

The procedure of Example 2 was repeated using a 0.5% solution of polyitaconic acid (MW 30,000). The wet strength was improved to the same extent as in the previous examples.

EXAMPLE 6

The procedure of Example 2 was repeated using polymethacrylic acid with similar results.

EXAMPLE 7

The procedure of Example 2 was repeated using polymaleic acid with similar results.

EXAMPLE 8

The procedure of Example 2 was repeated using copolymaleic acid/acrylic acid with similar results.

EXAMPLE 9

The procedure of Example 2 was repeated using the half ethyl ester of copolymaleic acid/methyl vinyl ether with similar results.

EXAMPLE 10

(Pilot Production Unit Control Experiment)

In this example, a conventional pilot production unit was employed. Accordingly, a 0.5% fiber glass dispersion was prepared in a mixing tank using a 20 ppm solution of dimethyl hydrogenated tallowamine oxide — (Aromox DMHT) from Armak. The fiber glass used was chopped E-glass (15 micron diameter and 1½" long). This dispersion was pumped into the headbox of the pilot machine and simultaneously diluted with fresh 20 ppm solution of dimethyl hydrogenated tallow amine oxide to give a final glass fiber consistency in the headbox of 0.14%. This diluted dispersion then was distributed onto a moving foraminous belt at such a rate that a wet mat of about 2 lbs. glass/100 sq. ft. was obtained. The wet mat so formed was of excellent quality insofar as uniformity of fiber distribution and fiber array was concerned; however, it had relatively poor wet-strength characteristics as formed. As a result, it was difficult to transfer this wet mat from the belt to the surfaces of the drum dryers across an unsupported gap of about 9 inches. The wet mat often broke as it was being manually transferred and even though the continuous wet mat flowed from the belt to the drier, the wet mat often broke at the unsupported junctions whenever the machine was stopped or if extra tension was applied at the unsupported bridging points.

EXAMPLE 11

The procedure of Example 10 was repeated except that the wet mat as it was formed in the foraminous belt was sprayed with a 0.1% solution of Gantrez ® S-95 (copoly maleic acid methyl vinyl ether) from GAF. The thus-treated wet mat had sufficient wet-strength to be easily transferred manually to the drum driers without breakage.

EXAMPLE 12

(Control Experiment - Coated Glass Fibers)

7g of chopped E-glass was added to 700 ml. of a 0.25% solution of Ethomeen ® T-25 (poly (15) ethoxylated tallowamine) from Armak. The mixture was agitated for a few minutes and filtered in a Buchner funnel under suction. The glass fibers, after filtration, retained about 40% of their own weight of the solution. The coated glass fibers then were air dried and suspended in 700 ml of a 0.1% solution of Arquad ® 18 (stearyl trimethyl ammonium chloride) from Armak, and agitated, whereupon a usable suspension of the glass fibers resulted. This suspension then was used to make a 10"×11" (110 sq. inches) wet mat using the paper-making apparatus. This wet mat, howeve, again, was too weak to be lifted up from the frame by holding at its two corners.

EXAMPLE 13

The procedure of Example 12 was repeated except that in addition the wet mat was sprayed with a 0.5% solution of Gantrez ® S-95 (copoly maleic acid methyl vinyl ether) from GAF. The treated mat now was strong enough to be lifted intact by holding its two corners.

EXAMPLE 14

The procedure of Example 13 was repeated except that polyacrylic acid (MW=30,000) was used in place of the above solution. The thus-treated wet mat again was much stronger so that it could be handled manually for further processing.

While the invention has been described with particular reference to certain embodiments thereof, it will be understood that certain changes and modifications may be made which are within the skill of the art. Accordingly, it is intended to be bound by the appended claims only.

What is claimed is:

1. In the manufacture of glass fiber mat products by the wet-laid process at a high rate of production wherein an aqueous dispersion of individual glass fibers is formed from bundles of glass fibers of about ¼ to 3 inches in length and an amine oxide dispersant or cationic quaternary ammonium dispersant compound having the formula:

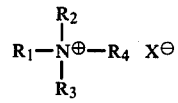

where $R_1$, $R_2$, $R_3$ and $R_4$ are selected from the group consisting of aliphatic and aromatic hydrocarbon radicals, straight chain or branched, or two or more form a cyclic group, saturated or unsaturated, substituted or unsubstituted, at least two of said radicals containing at least 10 carbon atoms each, being the same or different, the sum of the carbon atoms in $R_1$, $R_2$, $R_3$ and $R_4$ being at least 22 and less than about 48, and X is an anion at a concentration of about 5–500 ppm and at a fiber consistency of about 0.001 to 3%, which dispersion is passed through a mat-forming screen to form a freshly-prepared wet-mat of said fibers, the improvement which comprises:

applying to said freshly-prepared wet mat an anionic polyelectrolyte having the structural formula:

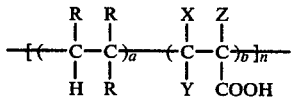

wherein each R can be the same or different and is selected from the group consisting of hydrogen, lower alkoxy, hydroxy, lower alkylcarbonyloxy, hydroxy lower alkyl, lower alkyl, phenyl, carboxy, lower alkoxycarbonyl, lower alkylcarbonyloxy lower alkyl, amido and carbamyl, with the proviso that only one R can be lower alkyl or phenyl; wherein X, Y and Z can be the same or different and are each selected from the group consisting of hydrogen, lower alkyl, carboxy, lower alkoxycarbonyl, with the proviso that at least one of X, Y and Z be selected from the group consisting of carboxy and lower alkoxycarbonyl, and, when X and Y are each lower alkoxycarbonyl, Z is carboxy or lower alkoxycarbonyl, with the further proviso that only one of X, Y and Z can be lower alkyl; a is 0 to less than 1 and a+b=1; and n is a whole integer which ranges from about 5 to about 10,000 thereby to improve the wet-strength properties of said freshly-prepared wet-mat so that it can be readily handled and transferred during other steps in said process, including the drying and binder application units of the production line for said process, into a finished glass fiber mat product.

2. The process according to claim 1 wherein the polyelectrolyte has an equivalent weight of less than 200, calculated as the acid form.

3. The process according to claim 1 wherein said polyelectrolyte is selected from the group consisting of homopolymers of acrylic acid, methacrylic acid, maleic acid, fumaric acid, itaconic acid and their copolymers with one or more copolymerizable monomers selected from the group consisting of an acrylamide, an acrylonitrile hydrolyzate, a lower alkyl ester of an unsaturated aliphatic acid, lower alkyl vinyl ethers, ethylene and styrene.

4. The process according to claim 1 wherein said polyelectrolyte is a polyacrylic acid, poly methacrylic acid or a copolymer of acrylic and methacrylic acids.

5. The process according to claim 1 wherein said polyelectrolyte is a copolymer of maleic acid and methyl vinyl ether.

6. The process according to claim 5 wherein said polyelectrolytes exhibit a molecular weight having a degree of polymerization (n) ranging from about 50 to about 3,000.

7. The process according to claim 1 wherein said anionic polyelectrolytes are selected from the group consisting of polyacrylic acid, polymethacrylic acid, polymaleic acid, polyitaconic acid, copolymaleic acid-/acrylic acid, copolymaleic acid/methylvinyl ether, and half methyl and ethyl esters of copolymaleic acid/-methyl vinyl ether.

8. The process according to claim 1 wherein said anionic polyelectrolyte is present in the form of a salt.

9. The process according to claim 8 wherein said salt is selected from the group consisting of an alkali metal, ammonium, alkyl-ammonium or low molecular weight organic amine.

10. The process according to claim 1 wherein said dispersion is formed by mixing said fibers in an aqueous medium with an amine oxide dispersant having the formula:

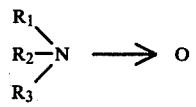

where $R_1$, $R_2$ and $R_3$ are selected from the group consisting of aliphatic and aromatic hydrocarbon radicals, substituted or unsubstituted, containing between 1 and 30 carbon atoms, being the same or different, the sum of $R_1$, $R_2$ and $R_3$ being between about 14 to 40.

11. A method according to claim 10 wherein the $R_1$, $R_2$ and $R_3$ radicals are aliphatic radicals.

12. A method according to claim 11 wherein said radicals are selected from alkyl, hydroxyalkyl and substituted radicals thereof.

13. A method according to claim 12 wherein said sum is about 18 to 24.

14. A method according to claim 10 wherein at least one of said radicals is lower alkyl or hydroxy lower alkyl, and at least one of said radicals is a long chain alkyl or alkyl substituted group.

15. A method according to claim 10 wherein said amine oxide is present in an amount of about 5–500 ppm of said aqueous dispersion.

16. A method according to claim 15 wherein said amount is about 10–25 ppm.

17. A method according to claim 10 wherein said glass fibers are present in a consistency of about 0.001% to about 3.0% of said dispersion.

18. A method according to claim 17 wherein consistency is about 0.05 to about 1%.

19. A method according to claim 10 wherein said amine oxide is selected from the group consisting of dimethyl hydrogenated tallow amine oxide, dimethylstearylamine oxide, dimethylhexadecylamine oxide and bis(2-hydroxyethyl) tallow amine oxide.

20. A method according to claim 10 which further comprises: precoating said glass fibers with said amine oxide, having the formula of claim 11 prior to forming said aqueous dispersion.

* * * * *